US010774780B2

(12) United States Patent
Sato

(10) Patent No.: US 10,774,780 B2
(45) Date of Patent: Sep. 15, 2020

(54) CYLINDER BORE WALL THERMAL INSULATOR, INTERNAL COMBUSTION ENGINE, AND AUTOMOBILE

(71) Applicant: NICHIAS CORPORATION, Tokyo (JP)

(72) Inventor: Junya Sato, Hamamatsu (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 16/334,148

(22) PCT Filed: Aug. 29, 2017

(86) PCT No.: PCT/JP2017/030910
§ 371 (c)(1),
(2) Date: Mar. 18, 2019

(87) PCT Pub. No.: WO2018/055993
PCT Pub. Date: Mar. 29, 2018

(65) Prior Publication Data

US 2019/0383229 A1 Dec. 19, 2019

(30) Foreign Application Priority Data

Sep. 21, 2016 (JP) ..... 2016-184143

(51) Int. Cl.
*F02F 1/14* (2006.01)
*F01P 3/02* (2006.01)
(Continued)

(52) U.S. Cl.
CPC ..... *F02F 1/14* (2013.01); *F01P 3/02* (2013.01); *F01P 2003/021* (2013.01);
(Continued)

(58) Field of Classification Search
CPC ..... F02F 1/14; F02F 1/166; F02F 1/18; F02F 1/36; F01P 3/02; F01P 2003/021
See application file for complete search history.

(56) References Cited

U.S. PATENT DOCUMENTS 9,032,916 B2 * 5/2015 Nishio ..... F02F 1/10 123/41.79
2003/0230254 A1 * 12/2003 Matsutani ..... F01P 3/02 123/41.79
(Continued)

FOREIGN PATENT DOCUMENTS

JP 2007-71039 A 3/2007
JP 2007071039 * 3/2007 ..... F02F 1/14
(Continued)

OTHER PUBLICATIONS

International Search Report dated Oct. 31, 2017, issued in counterpart International Application No. PCT/JP2017/030910 (2 pages).
(Continued)

*Primary Examiner* — Syed O Hasan
(74) *Attorney, Agent, or Firm* — Westerman, Hattori, Daniels & Adrian, LLP

(57) ABSTRACT

A cylinder bore wall thermal insulator is installed in a groove-like coolant passage of a cylinder block having cylinder bores in an internal combustion engine to insulate the entire bore wall of all the cylinder bores or part of the bore wall of all the cylinder bores. The thermal insulator includes: a base member made of a synthetic resin and having a shape conforming to the shape of the groove-like coolant passage at the installation position of the thermal insulator; a cylinder bore wall thermal insulating member formed of a heat-expandable rubber and affixed to the inside of the base member; and a cylinder bore opposite wall contact member formed of a heat-expandable rubber and affixed to the outside of the base member. A thermal insu-
(Continued)

lator can be obtained which is less likely to be displaced in the groove-like coolant passage, and is readily manufactured.

9 Claims, 11 Drawing Sheets

(51) Int. Cl.
*F02F 1/16* (2006.01)
*F02F 1/18* (2006.01)
*F02F 1/36* (2006.01)

(52) U.S. Cl.
CPC ..... *F02F 1/166* (2013.01); *F02F 1/18* (2013.01); *F02F 1/36* (2013.01)

(56) References Cited

U.S. PATENT DOCUMENTS

| | | | | |
|---|---|---|---|---|
| 2010/0242868 | A1* | 9/2010 | Shikida | F01P 3/02 123/41.79 |
| 2015/0267636 | A1* | 9/2015 | Nagai | F02F 1/16 123/41.72 |

FOREIGN PATENT DOCUMENTS

| | | | | | |
|---|---|---|---|---|---|
| JP | 2008-31939 | A | | 2/2008 | |
| JP | 2012-202290 | A | | 10/2012 | |
| JP | 2015-203313 | A | | 11/2015 | |
| JP | 2015203313 | | * | 11/2015 | F02F 1/14 |
| JP | 2015-229988 | A | | 12/2015 | |
| JP | 2015229988 | | * | 12/2015 | F02F 1/14 |

OTHER PUBLICATIONS

Office Action dated Mar. 11, 2020, issued in counterpart KR Application No. 10-2019-7007235, with English Translation. (11 pages).

* cited by examiner

CYLINDER BORE WALL THERMAL INSULATOR, INTERNAL COMBUSTION ENGINE, AND AUTOMOBILE

TECHNICAL FIELD

The present invention relates to a thermal insulator disposed in contact with a wall surface of a cylinder bore wall that defines on a groove-like coolant passage in a cylinder block of an internal combustion engine, an internal combustion engine including the same, and an automobile including the internal combustion engine.

BACKGROUND ART

In an internal combustion engine, fuel explosion occurs at the top dead center of the piston in a bore, and the explosion pushes the piston downward. Because of such a structure, the temperature of the cylinder bore wall is high on the upper side and low on the lower side. This causes a difference in the amount of thermal deformation between the upper side and the lower side of the cylinder bore wall, so that the upper side significantly expands whereas the lower side less expands.

Consequently, the frictional resistance of the piston against the cylinder bore wall increases, leading to lower fuel efficiency. It is therefore demanded to reduce the difference in the amount of thermal deformation between the upper side and the lower side of the cylinder bore wall.

Attempts have been made to homogenize the wall temperature of the cylinder bore wall by installing a spacer in a groove-like coolant passage and regulating the flow of a coolant in the groove-like coolant passage to control the efficiency of cooling the upper side and cooling the lower side of the cylinder bore wall with the coolant. For example, Patent Literature 1 discloses an internal combustion engine heat medium passage partition member. The partition member is disposed in a groove-like heat medium passage for cooling an internal combustion engine to divide the groove-like heat medium passage into a plurality of passages. The partition member includes: a passage dividing member having a height below the depth of the groove-like heat medium passage and serving as a wall for dividing the groove-like heat medium passage into a bore-side passage and a non-bore-side passage; and a flexible lip extending from the passage dividing member toward the opening of the groove-like heat medium passage and formed of a flexible material in such a shape that its front edge extends beyond the inner surface of one of the groove-like heat medium passages. After the flexible lip is inserted into the groove-like heat medium passage, the front edge comes into contact with the inner surface at an intermediate position in the depth direction of the groove-like heat medium passage, because of its own flexure restoring force, whereby the bore-side passage and the non-bore-side passage are separated from each other.

CITATION LIST

Patent Literature

Patent Literature 1: Japanese Patent Laid-Open Patent Publication No. 2008-31939 (claims)

SUMMARY OF INVENTION

Technical Problem

The internal combustion engine heat medium partition member in the cited literature 1 can homogenize the wall temperature of the cylinder bore wall to some extent and thus can reduce the difference in the amount of thermal deformation between the upper side and the lower side of the cylinder bore wall. However, there has been a demand for further reducing the difference in the amount of thermal deformation between the upper side and the lower side of the cylinder bore wall.

In view of such a situation, the wall temperature of the cylinder bore wall has recently been homogenized by actively insulating the cylinder bore-side wall surface at an intermediate lower position of the groove-like coolant passage of the cylinder block. In order to effectively insulate the cylinder bore-side wall surface at the intermediate lower position of the groove-like coolant passage, the thermal insulator need to be in intimate contact with the cylinder bore-side wall surface at the intermediate lower position of the groove-like coolant passage.

There has been a growing demand for selectively insulating a particular part of the cylinder bore-side wall surface. In order to meet such a demand, there is a need for a partial thermal insulator that insulates a part in the circumferential direction, rather than a whole-circumference thermal insulator that entirely insulates the cylinder bore-side wall surface in the circumferential direction. However, the partial thermal insulator is easily displaced in the groove-like coolant passage, compared with the whole-circumference thermal insulator. The whole-circumference thermal insulator is less displaced than the partial type but is far from free from displacement.

When the thermal insulator includes a metal base member to which a thermal insulating member is fixed, the processing and assembling of the thermal insulating member and the base member is complicated. A thermal insulator that is readily manufactured therefore has been sought.

An object of the present invention is to provide a thermal insulator that can be intimate contact with the cylinder bore-side wall surface of the groove-like coolant passage, is less likely to be displaced in the groove-like coolant passage, and is readily manufactured.

Solution to Problem

The problem above is solved by the present invention below. Specifically, the present invention (1) provides a cylinder bore wall thermal insulator installed in a groove-like coolant passage of a cylinder block having cylinder bores in an internal combustion engine, for insulating the entire bore wall of all the cylinder bores or part of the bore wall of all the cylinder bores. The thermal insulator includes:

a base member made of a synthetic resin and having a shape conforming to the shape of the groove-like coolant passage at an installation position of the thermal insulator;

a cylinder bore wall thermal insulating member formed of a heat-expandable rubber and affixed to the inside of the base member; and a cylinder bore opposite wall contact member formed of a heat-expandable rubber and affixed to the outside of the base member.

According to the present invention (2), in the cylinder bore wall thermal insulator of (1), the heat-expandable rubber forming the cylinder bore wall thermal insulating member and the heat-expandable rubber forming the cylinder bore opposite wall contact member are formed with a base foam material and a thermoplastic substance. The base foam material is silicone rubber, fluororubber, natural rubber, butadiene rubber, ethylene-propylene-diene rubber, or nitrile-butadiene rubber. The thermoplastic substance is a resin or a metal material.

According to the present invention (3), in the cylinder bore wall thermal insulator of (1) or (2), the ratio $((t_{i\text{-}IN}/t_{0\text{-}IN})\times 100)$ of the thickness $(t_{i\text{-}IN})$ of the cylinder bore wall thermal insulating member before heat expansion to the thickness $(t_{0\text{-}IN})$ of the cylinder bore wall thermal insulating member in a release state as well as the ratio $((t_{i\text{-}OUT}/t_{0\text{-}OUT})\times 100)$ of the thickness $(t_{i\text{-}OUT})$ of the cylinder bore opposite wall contact member before heat expansion to the thickness $(t_{0\text{-}OUT})$ of the cylinder bore opposite wall contact member in a release state are 6 to 87%.

According to the present invention (4), in the cylinder bore wall thermal insulator of any one of (1) to (3), the base member has an inside surface having a depression for preventing displacement of the cylinder bore wall thermal insulating member, and the cylinder bore wall thermal insulating member covers the depression.

According to the present invention (5), in the cylinder bore wall thermal insulator of any one of (1) to (3), the base member has an outside surface having a depression for preventing displacement of the cylinder bore opposite wall contact member, and the cylinder bore opposite wall contact member covers the depression.

According to the present invention (6), in the cylinder bore wall thermal insulator of any one of (1) to (5), a thermal insulating member formed of a heat-expandable rubber is disposed also on a bottom side of the base member.

The present invention (7) provides an internal combustion engine including a cylinder block having a groove-like coolant passage, in which the cylinder bore wall thermal insulator of any one of (1) to (6) is installed in the groove-like coolant passage.

According to the present invention (8), in the internal combustion engine of (7), a value represented by Expression (1) below is 17 to 75%:

$$((w-t_x)/(t_{0\text{-}IN}+t_{0\text{-}OUT}))\times 100 \quad (1)$$

(in Expression (1), w is the passage width of the groove-like coolant passage, $t_x$ is the thickness of the base member, $t_{0\text{-}IN}$ is the thickness of the cylinder bore wall thermal insulating member in a release state, and $t_{0\text{-}OUT}$ is the thickness of the cylinder bore opposite wall contact member in a release state).

According to the present invention (9), in the internal combustion engine of (7), a value represented by Expression (2) below is 17 to 75%:

$$((t_{a\text{-}IN}+t_{a\text{-}OUT})/(t_{0\text{-}IN}+t_{0\text{-}OUT}))\times 100 \quad (2)$$

(in Expression (2), $t_{a\text{-}IN}$ is the thickness of the cylinder bore wall thermal insulating member after expanding in the groove-like coolant passage, $t_{a\text{-}OUT}$ is the thickness of the cylinder bore opposite wall contact member after expanding in the groove-like coolant passage, $t_{0\text{-}IN}$ is the thickness of the cylinder bore wall thermal insulating member in a release state, and $t_{0\text{-}OUT}$ is the thickness of the cylinder bore opposite wall contact member in a release state).

The present invention (10) provides an automobile including the internal combustion engine of any one of (7) to (9).

Advantageous Effects of Invention

The present invention provides a thermal insulator that can be in intimate contact with the cylinder bore-side wall surface of the groove-like coolant passage, is less likely to be displaced in the groove-like coolant passage, and is readily manufactured.

DESCRIPTION OF EMBODIMENTS

Figure 1:
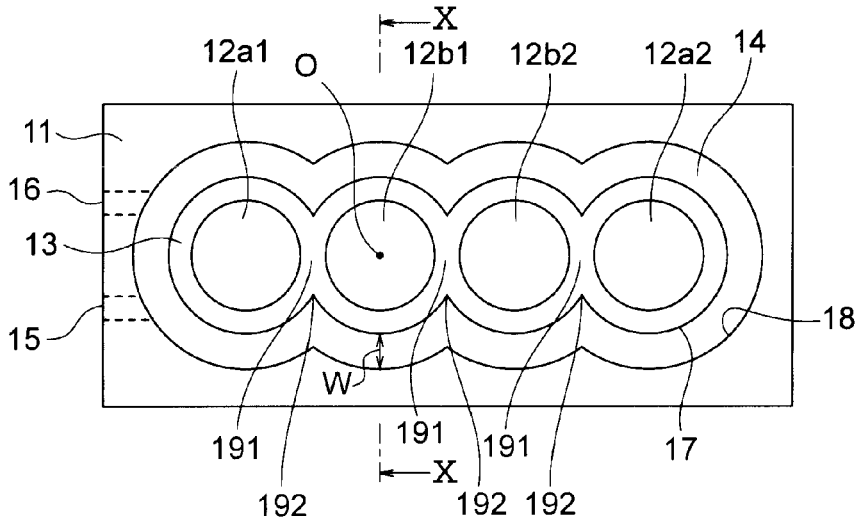
FIG. 1 is a schematic plan view illustrating a cylinder block in which a cylinder bore wall thermal insulator in the present invention is installed.
Figure 2:
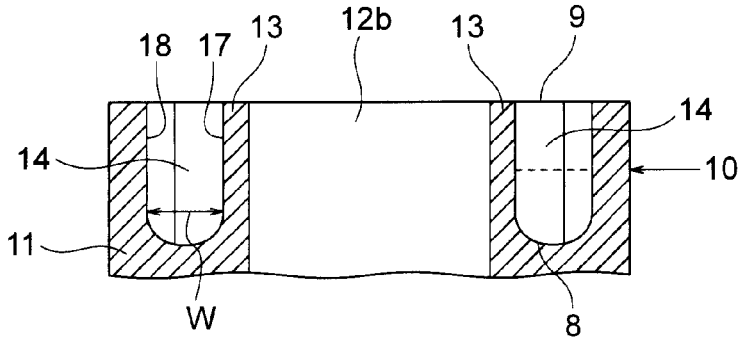
FIG. 2 is a cross-sectional view taken along line x-x in FIG. 1.
Figure 3:
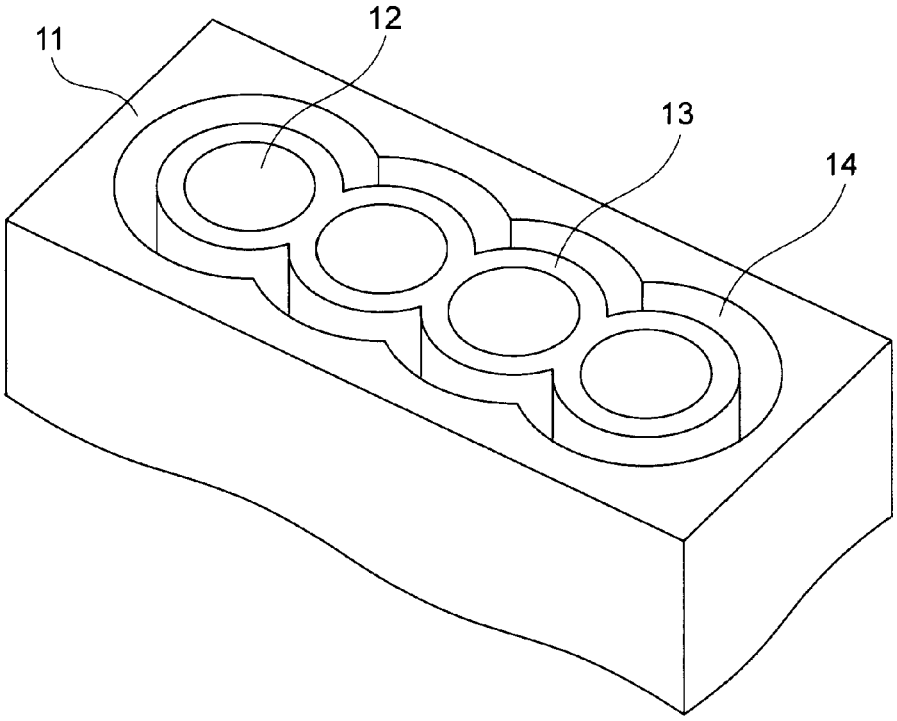
FIG. 3 is a perspective view of the cylinder block illustrated in FIG. 1.
Figure 4:
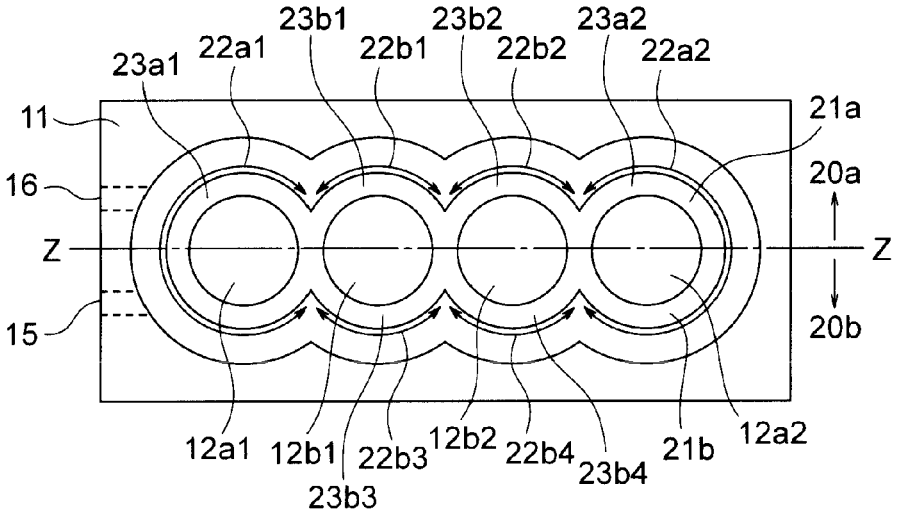
FIG. 4 is a schematic plan view illustrating the cylinder block in which the cylinder bore wall thermal insulator in the present invention is installed.
Figure 5:
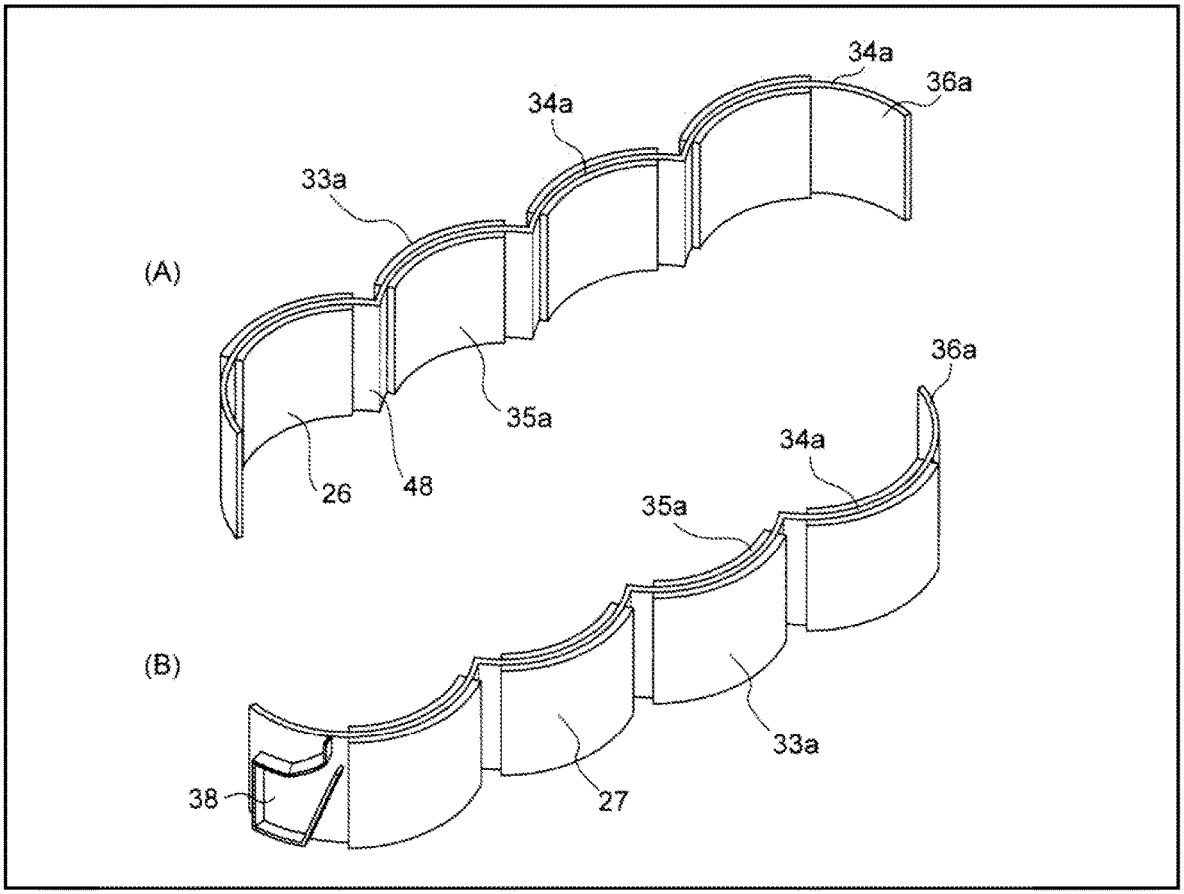
FIG. 5 is a schematic perspective view illustrating an example of the cylinder bore wall thermal insulator in the present invention.
Figure 6:
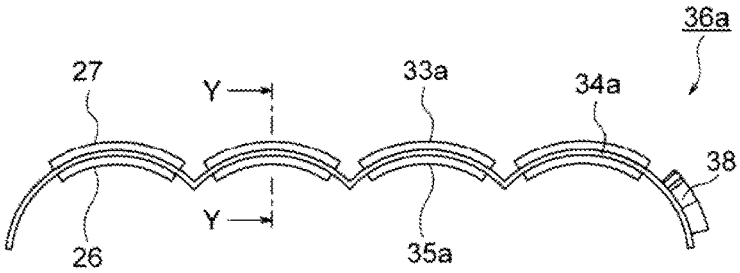
FIG. 6 is a plan view of the cylinder bore wall thermal insulator 36*a* in FIG. 5 as viewed from above.
Figure 7:
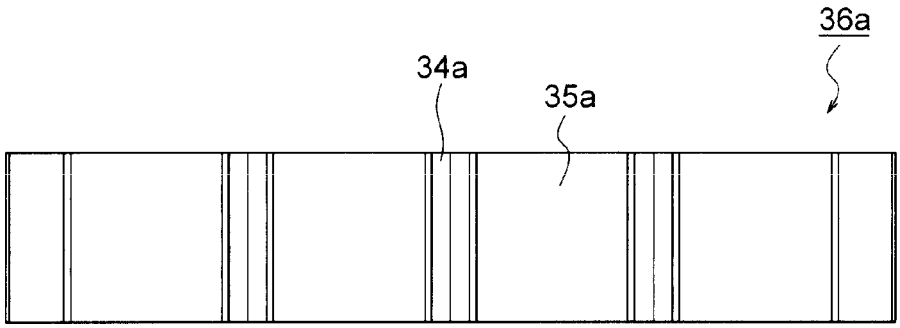
FIG. 7 is a side view of the cylinder bore wall thermal insulator 36*a* in FIG. 5 as viewed from inside.
Figure 8:
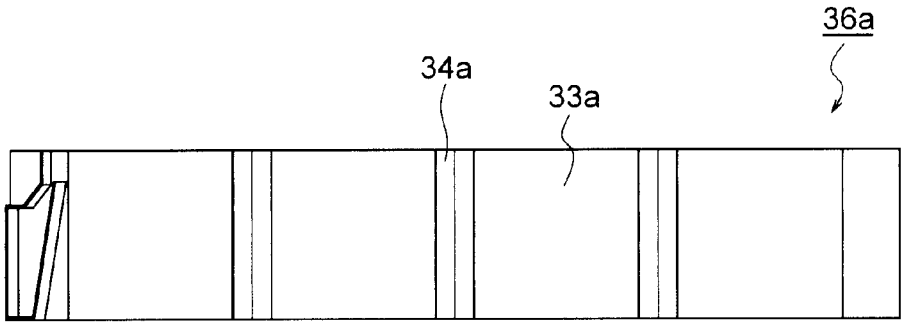
FIG. 8 is a side view of the cylinder bore wall thermal insulator 36*a* in FIG. 5 as viewed from outside.
Figure 9:
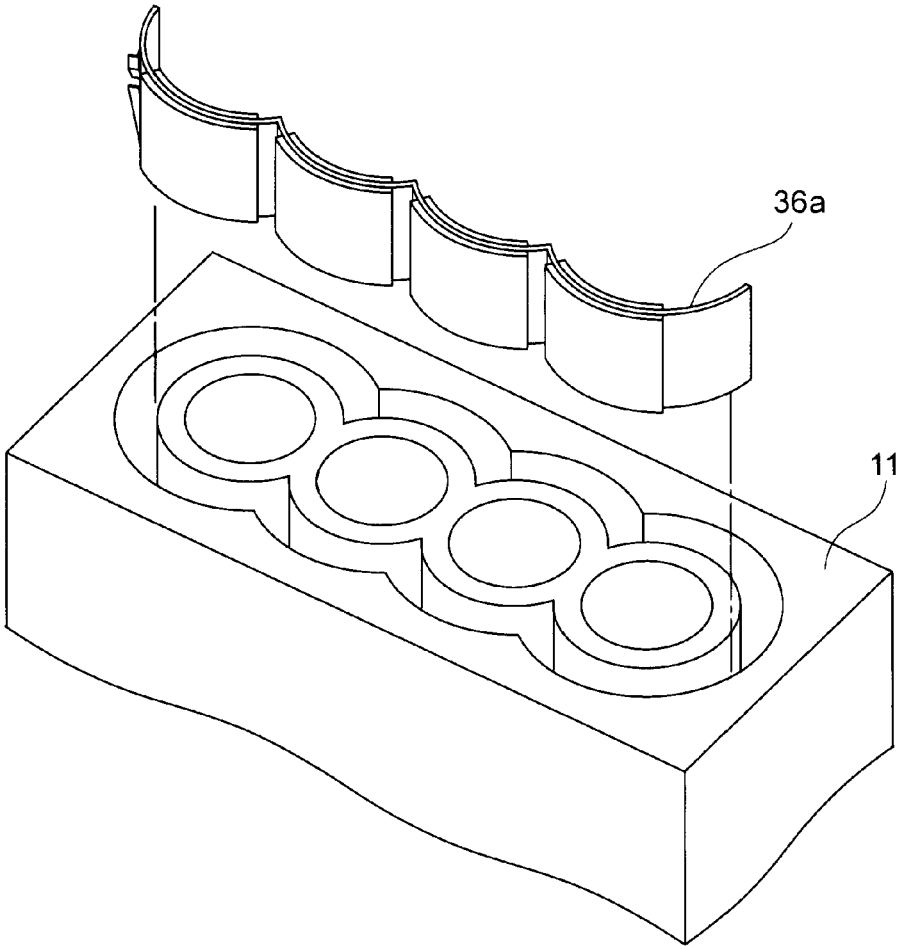
FIG. 9 is a diagram illustrating the cylinder bore wall thermal insulator 36*a* inserted into the cylinder block 11 illustrated in FIG. 1.
Figure 10:
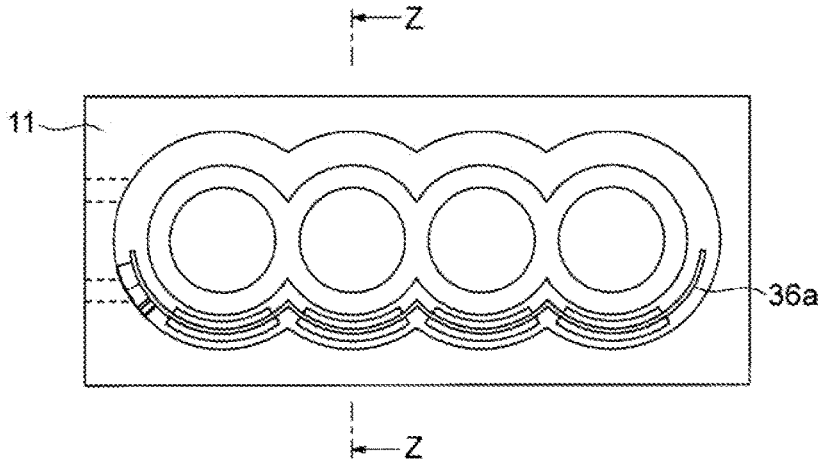
FIG. 10 is a diagram illustrating a state after the cylinder bore wall thermal insulator 36*a* is installed in a groove-like coolant passage 14 of the cylinder block 11 illustrated in FIG. 1 and before a heat-expandable rubber expands.
Figure 11:
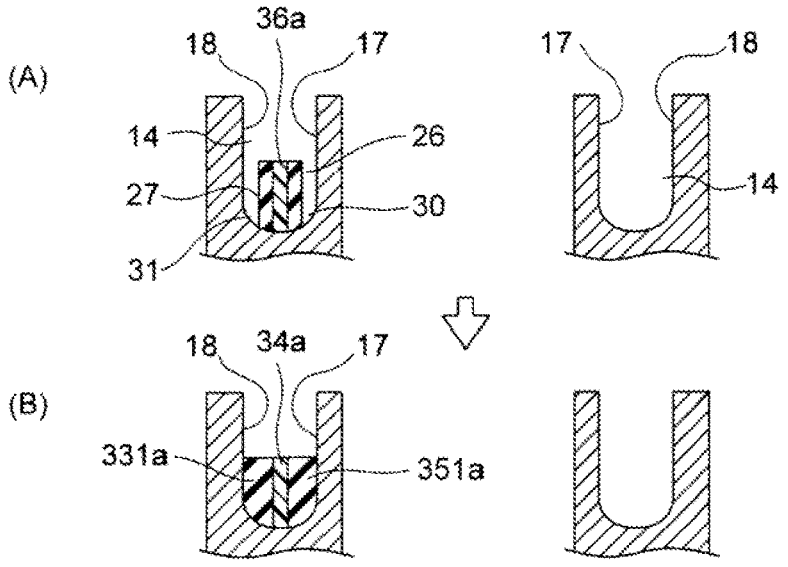
FIG. 11 is a diagram illustrating the cylinder bore wall thermal insulator 36*a* installed in the cylinder block 11 illustrated in FIG. 1.

A cylinder bore wall thermal insulator in the present invention and an internal combustion engine in the present invention will be described with reference to FIG. 1 to FIG. 11. FIG. 1 to FIG. 4 illustrate an example of a cylinder block in which the cylinder bore wall thermal insulator in the present invention is installed. FIG. 1 and FIG. 4 are schematic plan views illustrating a cylinder block in which the cylinder bore wall thermal insulator in the present invention is installed. FIG. 2 is a cross-sectional view taken along line x-x in FIG. 1. FIG. 3 is a perspective view of the cylinder block illustrated in FIG. 1. FIG. 5 is a schematic perspective view illustrating an example of the cylinder bore wall thermal insulator in the present invention. FIG. 6 is a top view of the thermal insulator 36*a* in FIG. 5. FIG. 7 is a side view of the thermal insulator 36*a* in FIG. 5 as viewed from inside. FIG. 8 is a side view of the thermal insulator 36*a* in FIG. 5 as viewed from outside. FIG. 9 is a diagram illustrating the cylinder bore wall thermal insulator 36*a* inserted into the cylinder block 11 illustrated in FIG. 1. FIG. 10 is a diagram illustrating a state after the cylinder bore wall thermal insulator 36*a* is installed in a groove-like coolant passage 14 of the cylinder block 11 illustrated in FIG. 1 and before a heat-expandable rubber expands. FIG. 11 is a diagram illustrating the cylinder bore wall thermal insulator 36*a* installed in the cylinder block 11 illustrated in FIG. 1, in which (A) is an end view taken along line Z-Z in FIG. 10, illustrating a state before the heat-expandable rubber expands, and (B) illustrates a state after the heat-expandable rubber expands.

As illustrated in FIG. 1 to FIG. 3, the cylinder bore wall thermal insulator is installed in the open-deck cylinder block 11 of a vehicle-mounted internal combustion engine. The cylinder block 11 has bores 12 in which pistons move up and down and a groove-like coolant passage 14 through which a coolant flows. A wall that separates the bores 12 from the groove-like coolant passage 14 is a cylinder bore wall 13. The cylinder block 11 has a coolant inlet 15 for supplying the coolant to the groove-like coolant passage 11 and a coolant outlet 16 for discharging the coolant from the groove-like coolant passage 11.

This cylinder block 11 has two or more bores 12 arranged in series. The bores 12 thus include end bores 12*a*1 and 12*a*2 each adjacent to one bore, and intermediate bores 12*b*1 and 12*b*2 sandwiched between two bores (when the cylinder block has two bores, the bores are always the end bores). Of the bores arranged in series, the end bores 12*a*1 and 12*a*2 are bores on both ends, and the intermediate bores 12*b*1 and 12*b*2 are bores between the end bore 12*a*1 on one end and the end bore 12*a*2 on the other end. The wall between the end bore 12*a*1 and the intermediate bore 12*b*1, the wall between the intermediate bore 12*b*1 and the intermediate bore 12*b*2, and the wall between the intermediate bore 12*b*2 and the end bore 12*a*2 (inter-bore wall 191) are each sandwiched between two bores and therefore receive heat from two cylinder bores, so that their wall temperature is higher than the other wall. Accordingly, the temperature in the cylinder bore-side wall surface 17 of the groove-like coolant passage 14 is highest in the vicinity of the inter-bore wall 191, and the temperature in the cylinder bore-side wall surface 17 of the groove-like coolant passage 14 is highest at the boundary 192 between the bore walls of the individual cylinder bores and the vicinity thereof.

In the present invention, in the wall surface of the groove-like coolant passage 14, the wall surface defining the cylinder bore 13 is referred to as the cylinder bore wall 17 of the groove-like coolant passage. In the wall surface of the groove-like coolant passage 14, the wall surface on the opposite side to the cylinder bore wall 17 of the groove-like coolant passage is referred to as the cylinder bore opposite wall 18.

In the present invention, one-side half refers to a half on one side of the cylinder block divided into two in the direction in which the cylinder bores are arranged. In the present invention, therefore, a one-side half bore wall of the bore wall of all the cylinder bores refers to the bore wall of a half on one side of the entire cylinder bore wall divided into two vertically in the direction in which the cylinder bores are arranged. For example, in FIG. 4, the direction in which the cylinder bores are arranged is the Z-Z direction, and each one-side half of the bore wall divided into two vertically with respect to line Z-Z is a one-side half bore wall of the bore wall of all the cylinder bores. That is, in FIG. 4, a one-side half bore wall on the 20*a* side with respect to line Z-Z is the one-side half bore wall 21*a* of the bore wall of all the cylinder bores, and a one-side half bore wall on the 20*b* side with respect to line Z-Z is the other-side half bore wall 21*b* of the bore wall of the entire cylinder bore. One side of the entire cylinder bore wall refers to either the one-side half bore wall 21*a* or the one-side half bore wall 21*b*. Part of one side refers to part of the one-side half bore wall 21*a* or part of the one-side half bore wall 21*b*.

In the present invention, the bore wall of each individual cylinder bore refers to the bore wall part corresponding to one cylinder bore. In FIG. 4, the range denoted by a double-headed arrow 22*a*1 is a bore wall 23*a*1 of the cylinder bore 12*a*1, the range denoted by a double-headed arrow 22*b*1 is a bore wall 23*b*1 of the cylinder bore 12*b*1, the range denoted by a double-headed arrow 22*b*2 is a bore wall 23*b*2 of the cylinder bore 12*b*2, the range denoted by a double-headed arrow 22*a*2 is a bore wall 23*a*2 of the cylinder bore 12*a*2, the range denoted by a double-headed arrow 22*b*3 is a bore wall 23*b*3 of the cylinder bore 12*b*1, and the range denoted by a double-headed arrow 22*b*4 is a bore wall 23*b*4 of the cylinder bore 12*b*2. That is, each of the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2, the bore wall 23*b*3 of the cylinder bore 12*b*1, and the bore wall 23*b*4 of the cylinder bore 12*b*2 is the bore wall of each individual cylinder bore.

A cylinder bore wall thermal insulator 36*a* illustrated in FIG. 5 is a thermal insulator for insulating the one-side half (20*b* side) bore wall 21*b* in FIG. 4. A coolant flow-separating member 38 is provided on the cylinder bore wall thermal insulator 36*a*. In the cylinder block 11 illustrated in FIG. 4, the coolant flow-separating member 38 is a member for separating the inlet 15 and the outlet 16 for a coolant such that the coolant supplied to the groove-like coolant passage 14 through the coolant inlet 15 does not discharge immediately from the nearby coolant outlet 16 but flows through the one-side half of the groove-like coolant passage 14 on the 20*b* side toward the end on the side opposite to the coolant inlet 15, turns into the one-side half of the groove-like coolant passage 14 on the 20*a* side when reaching the end on the side opposite to the coolant inlet 15 of the one-side half of the groove-like coolant passage 14 on the 20*b* side, subsequently flows through the one-side half of the groove-like coolant passage 14 on the 20*a* side toward the coolant outlet 16, and finally discharges from the coolant outlet 16. FIG. 4 illustrates an example of the cylinder block in which the coolant, flowing through the one-side half of the groove-like coolant passage 14 on the 20*a* side to the end, discharges from the coolant outlet 16 on a side of the cylinder block 11. In another example of the cylinder block, for example, the coolant flowing through the one-side half of the groove-like coolant passage 14 on the 20*a* side from one end to the other end does not discharge from a side of the cylinder block but flows into a coolant passage formed in the cylinder head.

As illustrated in FIG. 5 to FIG. 8, the cylinder bore wall thermal insulator 36*a* includes a base member 34*a*, a cylinder bore wall thermal insulating member 35*a* affixed to the inside of the base member 34*a* and including four separate parts, and a cylinder bore opposite wall contact member 33*a* affixed to the outside of the base member 34*a* and including four separate parts. In the cylinder bore wall thermal insulator 36*a*, the cylinder bore wall thermal insulating member 35*a* is affixed to the inside surface of the base member 34*a*, for example, by adhesive or adhesive tape. The cylinder bore opposite wall contact member 33*a* is affixed to the outside surface of the base member 34*a*, for example, by adhesive or adhesive tape.

The cylinder bore wall thermal insulator 36*a* is a thermal insulator for insulating the one-side half bore wall 21*b* of the cylinder block 11 illustrated in FIG. 4. The one-side half bore wall 21*b* of the cylinder block 11 includes four bore walls of individual cylinder bores, namely, the bore wall 23*a*1 of the cylinder bore 12*a*1, the bore wall 23*b*3 of the cylinder bore 12*b*1, the bore wall 23*b*4 of the cylinder bore 12*b*2, and the bore wall 23*a*2 of the cylinder bore 12*a*2. Then, in the cylinder bore wall thermal insulator 36*a*, the cylinder bore wall thermal insulating member 35*a* is provided for the four bore walls of individual cylinder bores. The cylinder bore wall thermal insulator 36*a* thus includes the cylinder bore wall thermal insulating member 35*a* including four separate parts.

In the cylinder bore wall thermal insulator 36*a*, the cylinder bore wall thermal insulating member 35*a* is affixed on the inside surface of the base member 34*a*, for example, by adhesive or adhesive tape such that a contact surface 26 of the cylinder bore wall thermal insulating member 35*a* faces the cylinder bore wall 17. In the cylinder bore wall thermal insulation part 36*a*, the cylinder bore opposite wall contact member 33*a* is affixed to the outside of the base member 34, for example, by adhesive or adhesive tape such that a contact surface 27 of the cylinder bore opposite wall contact member 33*a* faces the cylinder bore opposite wall 18.

The cylinder bore wall thermal insulating member 35*a* and the cylinder bore opposite wall contact member 33*a* are formed of a heat-expandable rubber. This heat-expandable rubber is a rubber material that has a base foam material compressed and constrained by a thermoplastic substance before expansion. When heated, the rubber material is released from the constraint by thermosetting resin and expands into the state before compression, that is, expands to a release state. The cylinder bore wall thermal insulating member 35*a* is thus a member for insulating the bore wall of each individual cylinder bore and expands by heating after the cylinder bore wall thermal insulator 36*a* is installed in the groove-like coolant passage 14 of the cylinder block 11. The cylinder bore wall thermal insulating member 35*a* then expands (heat expansion) by heating, whereby the contact surface 26 comes into contact with the cylinder bore wall 17 of the groove-like coolant passage 14 to cover the wall surface of the cylinder bore wall 17 of the groove-like coolant passage 14. The cylinder bore opposite wall contact member 33*a* expands by heating after the cylinder bore wall thermal insulator 36*a* is installed in the groove-like coolant passage 14 of the cylinder block 11. The cylinder bore opposite wall contact member 33*a* expands by heating (heat expansion), whereby the contact surface 27 comes into contact with the cylinder bore opposite wall 18 of the groove-like coolant passage 14.

When the cylinder bore wall thermal insulating member 35*a* and the cylinder bore opposite wall contact member 33*a* start expanding by heating in the groove-like coolant passage 14, the cylinder bore wall thermal insulating member 35*a* expands until the contact surface 26 comes into contact with the cylinder bore wall 17, the cylinder bore opposite wall contact member 33*a* expands until the contact surface 27 comes into contact with the cylinder bore opposite wall 18, and they further attempt to expand until reaching a release state. Therefore, the force of the expanding heat-expandable rubber attempting to restore to a release state, that is, the elastic force of the expanded heat-expandable rubber, is applied to the cylinder bore wall 17 and the cylinder bore opposite wall 18. The elastic force of the expanded heat-expandable rubber pushes the cylinder bore wall thermal insulating member 35*a* against the cylinder bore wall 17 and pushes the cylinder bore opposite wall contact member 33*a* against the cylinder bore opposite wall 18. Through such action, the cylinder bore wall thermal insulator 36*a* is held in the groove-like coolant passage 14. Since the cylinder bore wall thermal insulating member 35*a* is in intimate contact with the cylinder bore wall 17 to cover the cylinder bore wall 17, the cylinder bore wall 17 is insulated by the cylinder bore wall thermal insulating member 35*a*.

The base member 34*a* is shaped such that four arcs are continuous as viewed from above. The shape of the base member 34*a* conforms to the one-side half of the groove-like coolant passage 14. The base member 34*a* is a member having the cylinder bore wall thermal insulating member 35*a* fixed on the inside and having the cylinder bore opposite wall contact member 33*a* fixed on the outside. The support 34*a* is a molded product of a synthetic resin.

The cylinder bore wall thermal insulator 36*a* is installed, for example, in the groove-like coolant passage 14 of the cylinder block 11 illustrated in FIG. 1. As illustrated in FIG. 10, the cylinder bore wall thermal insulator 36*a* is installed in the groove-like coolant passage 14 by inserting the cylinder bore wall thermal insulator 36*a* into the groove-like coolant passage 14 of the cylinder block 11 as illustrated in FIG. 9. When the cylinder bore wall thermal insulator 36*a* is inserted into the groove-like coolant passage 14, the cylinder bore wall thermal insulating member 35*a* and the cylinder bore opposite wall contact member 33*a* are not yet expanded and, therefore, the width of the cylinder bore wall thermal insulator 36*a*, that is, the sum of the thickness of the cylinder bore wall thermal insulating member 35*a*, the thickness of the base member 34*a*, and the thickness of the cylinder bore opposite wall contact member 33*a* is smaller than the passage width of the groove-like coolant passage 14. For this reason, when the cylinder bore wall thermal insulator 36*a* is inserted into the groove-like coolant passage 14, the contact surface 26 of the cylinder bore wall thermal insulating member 35*a* does not come into contact with the cylinder bore wall 17, and the contact surface 27 of the cylinder bore opposite wall contact member 33*a* does not come into contact with the cylinder bore opposite wall 18.

After the cylinder bore wall thermal insulator 36*a* is installed in the groove-like coolant passage 14, before heating, a gap 30 exists between the contact surface 26 of the cylinder bore wall thermal insulating member and the cylinder bore wall 17 as illustrated in FIG. 11(A), and a gap 31 exists between the contact surface 27 of the cylinder bore opposite wall contact member and the cylinder bore opposite wall 18. However, when the heat-expandable rubber is heated, as illustrated in FIG. 11(B), the cylinder bore wall thermal insulating member 351*a* expands until coming into contact with the cylinder bore wall 17, and the cylinder bore opposite wall contact member 331*a* expands until coming into contact with the cylinder bore opposite wall 18.

The cylinder bore wall thermal insulator in the present invention is installed in a groove-like coolant passage of a cylinder block having cylinder bores in an internal combustion engine to insulate the entire bore wall of all the cylinder bores or part of the bore walls of all the cylinders. The cylinder bore wall thermal insulator includes:

a base member made of a synthetic resin and having a shape conforming to the shape of the groove-like coolant passage at an installation position of the thermal insulator;

a cylinder bore wall thermal insulating member formed of a heat-expandable rubber (before heat expansion) and affixed to the inside of the base member; and a cylinder bore opposite wall contact member formed of a heat-expandable rubber (before heat expansion) and affixed to the outside of the base member.

The cylinder bore wall thermal insulator in the present invention is installed in the groove-like coolant passage of the cylinder block of the internal combustion engine. The cylinder block in which the cylinder bore wall thermal insulator in the present invention is installed is an open-deck cylinder block having two or more cylinder bores arranged in series. When the cylinder block is an open-deck cylinder block having two or more cylinder bores arranged in series, the cylinder block has cylinder bores including two end bores. When the cylinder block is an open-deck cylinder block having three or more cylinder bores arranged in series, the cylinder block has cylinder bores including two end bores and one or more intermediate bores. In the present invention, of the cylinder bores arranged in series, the bores on both ends are referred to as end bores, and a bore sandwiched between other cylinder bores on both sides is referred to as an intermediate bore.

The cylinder bore wall thermal insulator in the present invention is installed in the groove-like coolant passage. In many internal combustion engines, the piston speed is high at the position corresponding to the intermediate lower portion of the groove-like coolant passage of the cylinder bore. It is therefore preferable to insulate the intermediate lower portion of the groove-like coolant passage. In FIG. 2, a position 10 in the vicinity of the intermediate between the uppermost position 9 and the lowermost position 8 of the groove-like coolant passage 14 is denoted by a dotted line. The portion of the groove-like coolant passage 14 below the position 10 in the vicinity of the intermediate is referred to as the intermediate lower portion of the groove-like coolant passage. The intermediate lower portion of the groove-like coolant passage does not mean a portion below the position exactly intermediate between the uppermost position and the lowermost position of the groove-like coolant passage but means a portion below the vicinity of the intermediate position between the uppermost position and the lowermost position. Depending on the structure of internal combustion engines, the piston speed may be high at the position corresponding to the lower portion of the groove-like coolant passage of the cylinder bore. In this case, it is preferable to insulate the lower portion of the groove-like coolant passage. Thus, up to which position from the lowermost position of the groove-like coolant passage is to be insulated by the cylinder bore wall thermal insulator in the present invention, that is, at which position in the up-down direction the upper end of the rubber member is situated, is selected as appropriate.

The cylinder bore wall thermal insulator in the present invention includes a base member, a cylinder bore wall thermal insulating member (before heat expansion) affixed to the inside of the base member, and a cylinder bore opposite wall contact member (before heat expansion) affixed to the outside of the base member. The cylinder bore wall thermal insulator in the present invention is a thermal insulator for insulating the whole of the cylinder bore-side wall surface of the groove-like coolant passage or part of the cylinder bore-side wall surface of the groove-like coolant passage, when viewed in the circumferential direction. That is, the cylinder bore wall thermal insulator in the present invention is a thermal insulator for insulating the entire bore wall of all the cylinder bores or part of the bore wall of all the cylinder bores, when viewed in the circumferential direction. The cylinder bore wall thermal insulator in the present invention may be a thermal insulator for insulating a one-side half of the bore wall of all the cylinder bores as in the example illustrated in FIG. 5, or a thermal insulator for insulating part of one side of the bore wall of all the cylinder bores as in the example illustrated in FIG. 12, or a thermal insulator for insulating the entire bore wall of all the cylinder bores as in the example illustrated in FIG. 13. In the present invention, a one-side half or part of one side means a one-side half or part of one side in the circumferential direction of the cylinder bore wall or the groove-like coolant passage.

The base member in the cylinder bore wall thermal insulator in the present invention is formed of a synthetic resin. That is, the base member is made of a synthetic resin. The synthetic resin forming the base member is any synthetic resin that is typically used for a cylinder bore wall thermal insulator or a water jacket spacer installed in a groove-like coolant passage of a cylinder block of an internal combustion engine and is selected as appropriate. The base member has a shape conforming to the shape of the groove-like coolant passage and is shaped such that arcs are continuously connected, when viewed from above, over a range in which the cylinder bore wall thermal insulating member is provided.

In the cylinder bore wall thermal insulator in the present invention, the cylinder bore wall thermal insulating member (before heat expansion) is positioned so as to cover the cylinder bore wall to be insulated after the heat-expandable rubber expands. The installation position, shape, and installation range of the cylinder bore wall thermal insulating member are selected as appropriate, depending on the number of bore walls of individual cylinder bores and the insulated area. For example, as in the example illustrated in FIG. 5, one cylinder bore wall thermal insulating member may be provided for the bore wall of each individual cylinder bore, that is, one for each bore portion of the base member. Alternatively, the cylinder bore wall thermal insulating member may be shaped so as to be continuous over the bore walls of two or more cylinder bores, that is, over two or more bore portions of the base member. In the present invention, each bore portion of the base member refers to one of the arc-shaped portions that constitute the base member and refers to the portion facing the bore wall of one cylinder bore.

In the cylinder bore wall thermal insulator in the present invention, the cylinder bore opposite wall contact member (before heat expansion) is provided on the base member on the opposite side to the side on which the cylinder bore wall thermal insulating member is provided. The cylinder bore opposite wall contact member as well as the cylinder bore wall contact member are heat-expanded to produce a force that pushes the cylinder bore wall and the cylinder bore opposite wall (the elastic force of the expanded heat-expandable rubber). This force holds the cylinder bore wall thermal insulator in the present invention in the groove-like coolant passage. The installation position, shape, and installation range of the cylinder bore opposite wall contact member are selected as appropriate so as to produce such a force. For example, as in the example illustrated in FIG. 5, one cylinder bore opposite wall contact member may be provided for the bore wall of each individual cylinder bore, that is, for each individual bore portion of the base member so as to be paired with the cylinder bore wall thermal insulating member, with the base member interposed. Alternatively, the cylinder bore opposite wall contact member may be shaped so as to be connected over the bore walls of two or more cylinder bores, that is, two or more bore portions of the base member.

The cylinder bore wall thermal insulating member (before heat expansion) and the cylinder bore opposite wall contact member (before heat expansion) are formed of a heat-expandable rubber in a compressed state. The heat-expandable rubber (compressed state) is a composite formed by impregnating a base foam material with a thermoplastic substance having a melting point lower than the base foam material. At room temperature, the compressed state is retained by the hardened thermoplastic substance present on the surface layer of the composite, and when heated, the hardened thermoplastic substance is softened so that the compressed state is released. Examples of the heat-expandable rubber include the heat-expandable rubber described in Japanese Patent Laid-Open Patent Publication No. 2004-143262.

Examples of the base foam material of the heat-expandable rubber include polymer materials such as rubbers, elastomers, thermoplastic resins, and thermosetting resins. Specific examples include natural rubbers, synthetic rubbers such as chloropropylene rubber, styrene-butadiene rubber, nitrile-butadiene rubber, ethylene-propylene-diene terpolymer, silicone rubber, fluororubber, and acrylic rubber, elastomers such as soft urethane, and thermosetting resins such as rigid urethane, phenolic resin, and melamine resin.

It is preferable that the thermoplastic substance of the heat-expandable rubber has a glass transition temperature, a melting point, or a softening temperature of lower than 120° C. Examples of the thermoplastic substance in the heat-expandable rubber include thermoplastic resins such as polyethylene, polypropylene, polystyrene, polyvinyl chloride, polyvinylidene chloride, polyvinyl acetate, polyacrylate, styrene-butadiene copolymer, chlorinated polyethylene, polyvinylidene fluoride, ethylene-vinyl acetate copolymer, ethylene-vinyl acetate-vinyl chloride-acrylate copolymer, ethylene-vinyl acetate-acrylate copolymer, ethylene-vinyl acetate-vinyl chloride copolymer, nylon, acrylonitrile-butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane, and thermoplastic substances such as low-melting-point glass frit, starch, solder, wax, stainless steel, and aluminum.

In the cylinder bore wall thermal insulator in the present invention, the cylinder bore wall thermal insulating member is affixed to the inside surface of the base member by adhesive, adhesive tape, glue, or the like. The cylinder bore opposite wall contact member is affixed to the outside surface of the base member by adhesive, adhesive tape, glue, or the like. In the present invention, the inside of the base member refers to the side facing the cylinder bore wall when installed in the groove-like coolant passage, and the outside of the base member refers to the side facing the cylinder bore opposite wall when installed in the groove-like coolant passage.

The cylinder bore wall thermal insulating member and the cylinder bore opposite wall contact member may be affixed to the base member by any means selected as appropriate. For example, the cylinder bore wall thermal insulating member and the cylinder bore opposite wall contact member are affixed to the base member by adhesive, adhesive tape, glue, or the like. In the cylinder bore wall thermal insulator in the present invention, after expansion of the heat-expandable rubber, the cylinder bore wall thermal insulating member and the cylinder bore opposite wall contact member are pushed against the base member by the elastic force of the expanded heat-expandable rubber. Therefore, even when the adhesive force of adhesive, adhesive tape, glue, or the like is not strong, the cylinder bore wall thermal insulating member and the cylinder bore opposite wall contact member are less likely to be displaced from the position where they are affixed to the base member by adhesive, adhesive tape, glue, or the like.

More specifically, as described later, when the inside surface of the base member has a depression for preventing displacement of the cylinder bore wall thermal insulating member, and when the outside surface of the base member has a depression for preventing displacement of the cylinder bore opposite wall contact member, the depressions for preventing displacement prevent the cylinder bore wall thermal insulating member and the cylinder bore opposite wall contact member from being displaced from the position where they are fixed to the base member by adhesive, adhesive tape, glue, or the like. Therefore, the adhesive force of adhesive, adhesive tape, glue, or the like may be to such a degree that the cylinder bore wall thermal insulating member and the cylinder bore opposite wall contact member do not separate from the surface of the base member until the cylinder bore wall thermal insulator in the present invention is inserted into the groove-like coolant passage.

Figure 14:
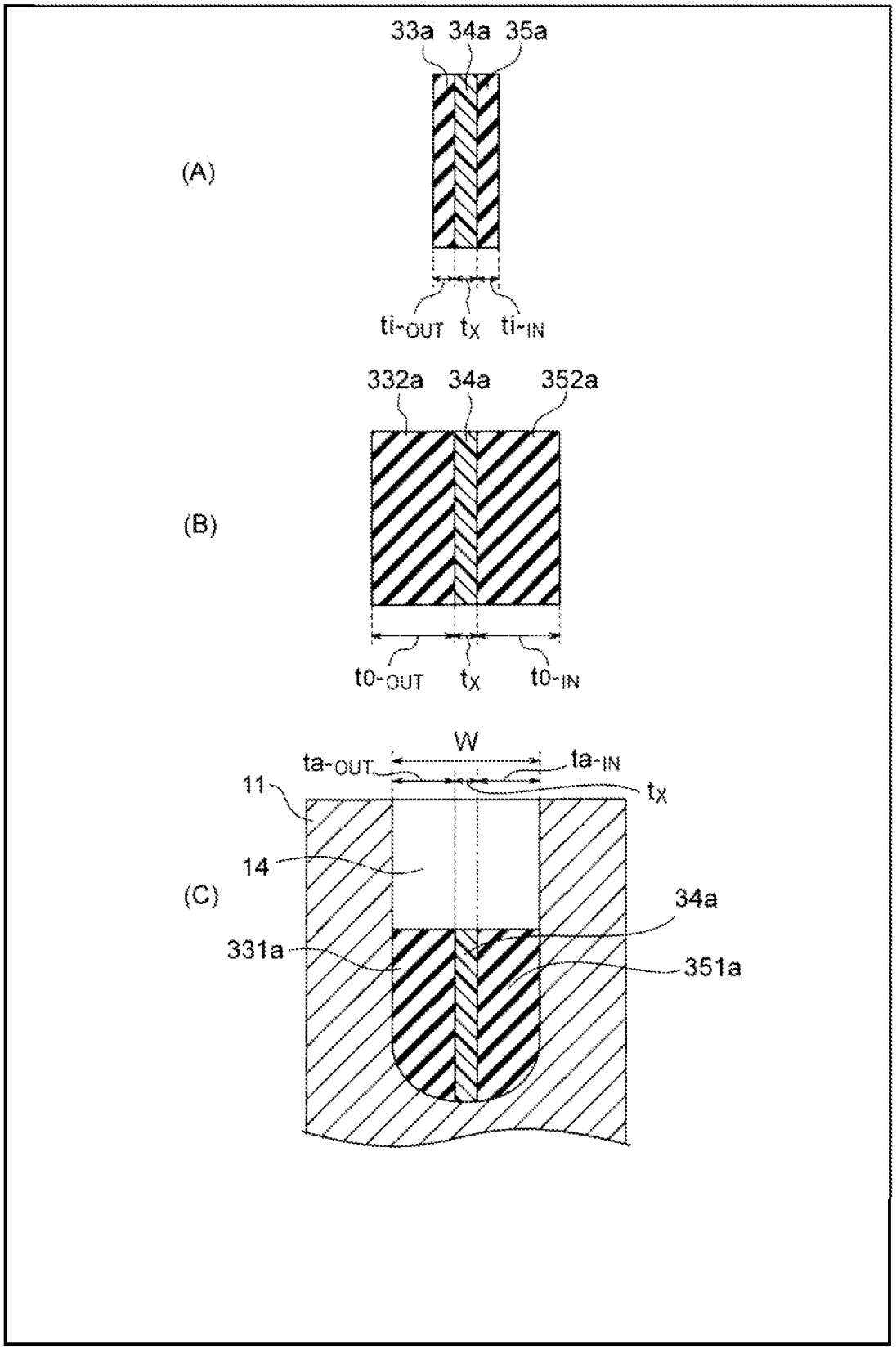
FIG. 14 is a diagram illustrating an example of the cylinder bore wall thermal insulator in the present invention in cross section.
Figure 15:
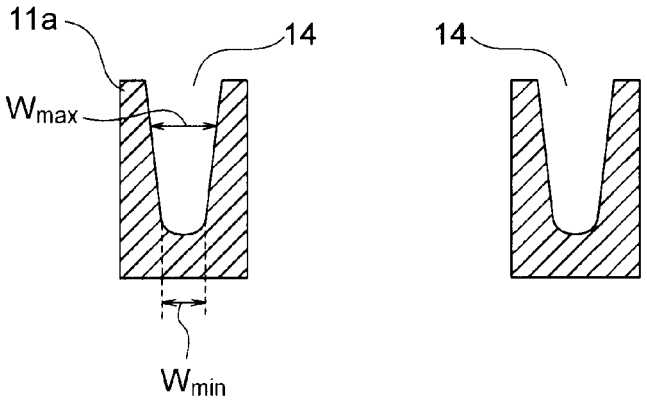
FIG. 15 is a diagram illustrating an example of the cylinder block.

In the cylinder bore wall thermal insulator in the present invention, the sum of the thickness ($t_{i\text{-}IN}$) of the cylinder bore wall thermal insulating member before heat expansion, the thickness ($t_x$) of the base member, and the thickness ($t_{i\text{-}OUT}$) of the cylinder bore opposite wall contact member before heat expansion is smaller than the passage width (w) of the groove-like coolant passage in which the cylinder bore wall thermal insulator in the present invention is installed. That is, "$(t_{i\text{-}IN}+t_x+t_{i\text{-}OUT})<w$". In the cylinder bore wall thermal insulator in the present invention, ($t_{i\text{-}IN}+t_x+t_{i\text{-}OUT}$) is selected as appropriate in the range of "$(t_{i\text{-}IN}+t_x+t_{i\text{-}OUT})<w$". In the present invention, as illustrated in FIG. 14(A), the thickness ($t_{i\text{-}IN}$) of the cylinder bore wall thermal insulating member before heat expansion is the thickness of the heat-expandable rubber when the heat-expandable rubber is constrained in a compressed state by the thermoplastic substance, that is, the thickness of the cylinder bore wall thermal insulating member before heat expansion. The thickness ($t_{i\text{-}OUT}$) of the cylinder bore opposite wall contact member before heat expansion is the thickness of the heat-expandable rubber when the heat-expandable rubber is constrained in a compressed state by the thermoplastic substance, that is, the thickness of the cylinder bore opposite wall contact member before heat expansion. The thickness ($t_x$) of the base member is the thickness of the base member as illustrated in FIG. 14(A). FIG. 14(A) is an end view of the cylinder bore wall thermal insulator 36*a* cut along line Y-Y in FIG. 6. The passage width (w) of the groove-like coolant passage is the width of the groove-like coolant passage 14 in a cross section (for example, the X-X cross-section in FIG. 1) of the cylinder block cut across a plane passing through the center line O of the cylinder bore, as illustrated in FIG. 1 and FIG. 2. In a cylinder block 11*a* illustrated in FIG. 15 in which the passage width varies when the groove-like coolant passage is viewed in the up-down direction, the relation of the sum of $t_{i\text{-}IN}$, $t_x$ and $t_{i\text{-}OUT}$ with w is determined at each position in the up-down direction after the cylinder bore wall thermal insulator in the present invention is installed in the groove-like coolant passage.

In the cylinder bore wall thermal insulator in the present invention, the compression ratio of the cylinder bore wall thermal insulating member before heat expansion, that is, the ratio $((t_{i\text{-}IN}/t_{0\text{-}IN})\times100)$ of the thickness $(t_{i\text{-}IN})$ of the cylinder bore wall thermal insulating member before heat expansion to the thickness $(t_{0\text{-}IN})$ of the cylinder bore wall thermal insulating member in a release state is preferably 6 to 87%, particularly preferably 17 to 46%. In the cylinder bore wall thermal insulator in the present invention, the compression ratio before heat expansion of the opposite wall contact member of the cylinder bore wall thermal insulating member, that is, the ratio $((t_{i\text{-}OUT}/t_{0\text{-}OUT})\times100)$ of the thickness $(t_{i\text{-}OUT})$ of the cylinder bore opposite wall contact member before heat expansion to the thickness $(t_{0\text{-}OUT})$ of the cylinder bore opposite wall contact member in a release state is preferably 6 to 87%, particularly preferably 17 to 46%. In the present invention, as illustrated in FIG. 14(B), the thickness $(t_{0\text{-}IN})$ of the cylinder bore wall thermal insulating member in a release state is the thickness of the heat-expandable rubber after expansion when the heat-expandable rubber is released from the constraint by the thermoplastic substance and expands in a release state free from restriction, that is, the thickness of the cylinder bore wall thermal insulating member 352*a* in a release state. As illustrated in FIG. 14(B), the thickness $(t_{0\text{-}OUT})$ of the cylinder bore opposite wall contact member in a release state is the thickness of the heat-expandable rubber after expansion when the heat-expandable rubber is released from the constraint by the thermoplastic substance and expands in a release state free from restriction, that is, the thickness of the cylinder bore opposite wall contact member 332*a* in a release state. FIG. 14(B) illustrates a state in which the cylinder bore wall thermal insulating member 35*a* and the cylinder bore opposite wall contact member 33*a* illustrated in FIG. 14(A) expand in a release state free from restriction on the expansion.

In the cylinder bore wall thermal insulator in the present invention, the cylinder bore wall thermal insulating member and the cylinder bore opposite wall contact member are affixed to the synthetic-resin base member by adhesive, adhesive tape, glue, or the like. For this reason, the cylinder bore wall thermal insulator in the present invention can be readily manufactured, compared with when a thermal insulator is manufactured by fixing a thermal insulating member to a metal base member.

Here, the adhesive force when the cylinder bore wall thermal insulating member and the cylinder bore opposite wall contact member are affixed to the base member by adhesive, adhesive tape, glue, or the like is weak compared with the fixing force when the cylinder wall thermal insulating member and the cylinder bore opposite wall contact member are fixed to the base member by folding a foldable part of a metal fixing member. The cylinder bore wall thermal insulating member and the cylinder bore opposite wall contact member formed of a heat-expandable rubber are expanded in the groove-like coolant passage, whereby the restoration force of the heat-expandable rubber pushes the cylinder bore wall thermal insulating member and the cylinder bore opposite wall contact member against the cylinder bore wall and the cylinder bore opposite wall. This pushing force is weaker than the bias force applied by a metal elastic member such as a metal leaf spring. However, in the cylinder bore wall thermal insulator in the present invention, the base member is formed of a synthetic resin lighter than a metal material. Therefore, the elastic force of the heat-expandable rubber after expansion of the cylinder wall thermal insulating member and the cylinder bore opposite wall contact member in the groove-like coolant passage is added to the adhesive force of adhesive, adhesive tape, glue, or the like, whereby the cylinder bore wall thermal insulator in the present invention is less likely to be displaced from the installation position in the groove-like coolant passage, and the cylinder wall thermal insulating member and the cylinder bore opposite wall contact member are less likely to be displaced from the position where they are affixed to the base member.

On the other hand, when the base member is formed of a metal material, because of the heavy weight of the base member, the elastic force of the heat-expandable rubber after expansion and the adhesive force of adhesive, adhesive tape, glue, or the like are insufficient to prevent displacement of the cylinder bore wall thermal insulator from the installation position in the groove-like coolant passage or displacement of the cylinder wall thermal insulating member and the cylinder bore opposite wall contact member from the position where they are affixed to the base member. The adhesive force of adhesive, adhesive tape, glue, or the like to the metal material is weaker than the adhesive force to the synthetic resin, and this is all the more reason to be insufficient to prevent the displacement described above.

It is preferable that the cylinder bore wall thermal insulator in the present invention has a depression on the inside surface of the base member for preventing displacement of the cylinder bore wall thermal insulating member and that the cylinder bore wall thermal insulating member covers the depression, in that the cylinder bore wall thermal insulating member and the cylinder bore opposite wall contact member are less likely to be displaced from the position where they are affixed to the base member in the groove-like coolant passage. It is also preferable that the cylinder bore wall thermal insulator in the present invention has a depression on the outside surface of the base member for preventing displacement of the cylinder bore opposite wall contact member and that the cylinder bore opposite wall contact member covers the depression, in that the cylinder bore wall thermal insulating member and the cylinder bore opposite wall contact member are less likely to be displaced from the position where they are affixed to the base member in the groove-like coolant passage. In a state in which the heat-expandable rubber is installed and expanded in the groove-like coolant passage, the expanded cylinder bore wall thermal insulating member and cylinder bore opposite wall contact member are engaged in the depression for preventing displacement of the cylinder bore wall thermal insulating member and the depression for preventing displacement of the cylinder bore opposite wall contact member. Thus, the depression for preventing displacement of the cylinder bore wall thermal insulating member and the depression for preventing displacement of the cylinder bore opposite wall contact member make the cylinder bore wall thermal insulating member and the cylinder bore opposite wall contact member less displaceable from the fixed position to the base member. The depressions for preventing displacement may be of any shape, for example, may be circular recesses, rectangular recesses, or circular or rectangular through holes. The formation position and the number of depressions for preventing displacement are selected as appropriate.

As in the example illustrated in FIG. 5, the cylinder bore wall thermal insulator in the present invention may have a coolant flow-separating member on one end side. The cylinder bore wall thermal insulator in the present invention may have a member on the support for preventing the entire thermal insulator from shifting upward. For example, cylinder head abutment members may be provided on the upper sides on both sides of the support such that their upper ends are in abutment with the cylinder head or the cylinder head gasket. The cylinder bore wall thermal insulator in the present invention may have any other member for regulating the flow of a coolant.

Figure 12:
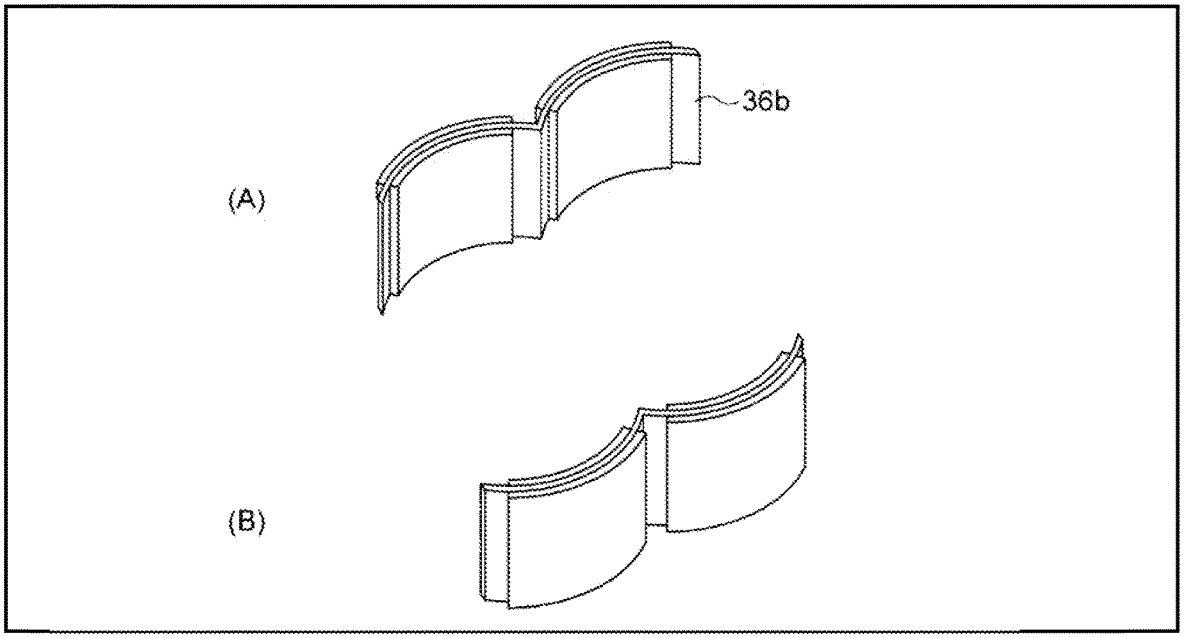
FIG. 12 is a diagram illustrating an example of the cylinder bore wall thermal insulator in the present invention.
Figure 13:
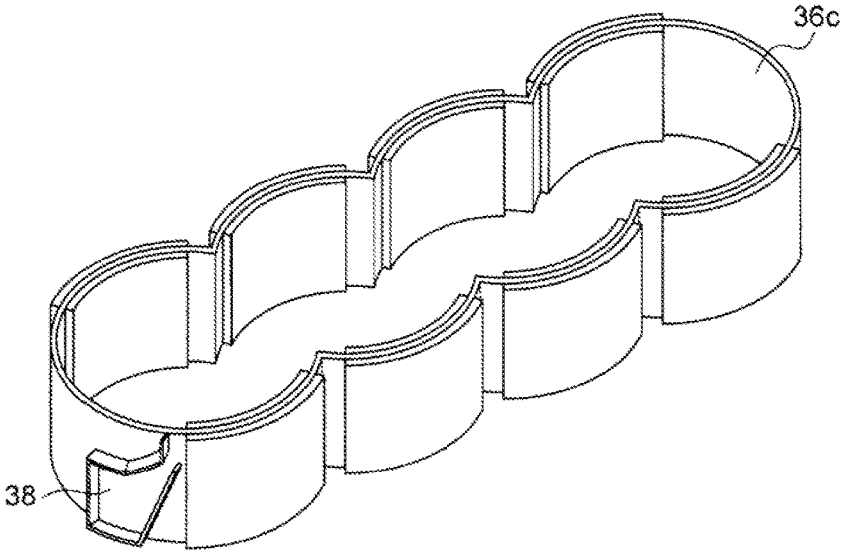
FIG. 13 is a diagram illustrating an example of the cylinder bore wall thermal insulator in the present invention.

The cylinder bore wall thermal insulator 36*a* illustrated in FIG. 5 is a thermal insulator for insulating a one-side half bore wall of the entire cylinder bore wall of the cylinder block 11 illustrated in FIG. 4. However, the cylinder bore wall thermal insulator in the present invention may be a thermal insulator for insulating part of one side of the entire cylinder bore wall, as in the example illustrated in FIG. 12. A cylinder bore wall thermal insulator 36*b* illustrated in FIG. 12 is a thermal insulator for insulating part of the one-side half bore wall 21*a* of the cylinder block 11 illustrated in FIG. 4, that is, the bore walls of the cylinder bores 12*b*1 and 12*b*2. FIG. 12 is a schematic perspective view of an example of the cylinder bore wall thermal insulator in the present invention, in which FIG. 12(A) is a perspective view inside from above, and FIG. 12(B) is a perspective view outside from above. The cylinder bore wall thermal insulator in the present invention may be a thermal insulator for insulating the entire bore wall of all the cylinder bores, as in the example illustrated in FIG. 13. A cylinder bore wall thermal insulator 36*c* illustrated in FIG. 13 is a thermal insulator for insulating the entire bore wall of all the cylinder bores of the cylinder block 11 illustrated in FIG. 4. That is, the cylinder bore wall thermal insulator in the present invention may be a thermal insulator for insulating the entire bore wall of all the cylinder bores of the cylinder block or may be an insulator for insulating part of the bore wall of all the cylinder bores of the cylinder block, for example, a one-side half or part of one side. FIG. 13 is a schematic perspective view of an example of the cylinder bore wall thermal insulator in the present invention.

FIG. 11 illustrates a state in which a cylinder bore wall thermal insulator with no thermal insulating member on the bottom side of the base member, as in the cylinder bore wall thermal insulator 36*a* illustrated in FIG. 5, is installed in the groove-like coolant passage of the cylinder block. However, the cylinder bore wall thermal insulator in the present invention may be a thermal insulator in which a thermal insulating member formed of a heat-expandable rubber is disposed also on the bottom side of the base member, as in the example illustrated in FIG. 16. In a cylinder bore wall thermal insulator 36*d* illustrated in FIG. 16, the thermal insulating member is disposed also on the bottom side of the base member 34*b*. As illustrated in FIG. 17, the cylinder bore wall thermal insulator 36*d* is fabricated by preparing a cylinder bore wall thermal insulating member 35*b* formed of a heat-expandable rubber and having a length in the up-down direction longer than the base member 34*b* and a cylinder bore opposite wall contact member 33*b* formed of a heat-expandable rubber and having a length in the up-down direction longer than the base member 34*b*, then affixing the cylinder bore wall thermal insulating member 35*b* and the cylinder bore opposite wall contact member 33*b* to the base member 34*b* such that the lower sides of the cylinder bore wall thermal insulating member 35*b* and the cylinder bore opposite wall contact member 33*b* extend beyond the lower side of the base member 34*b*, then affixing a lower inside surface 353*b* of the cylinder bore wall thermal insulating member 35*b* and a lower inside surface 333*b* of the cylinder bore opposite wall contact member 33*b* to a bottom surface 343*b* of the base member 34*b* to cover the bottom surface 343*b* of the base member 34*b*, and further affixing the lower inside surface 353*b* of the cylinder bore wall thermal insulating member 35*b* and the lower inside surface 333*b* of the cylinder bore opposite wall contact member 33*b*. Here, in FIG. 17, the lower inside surface 353*b* of the cylinder bore wall thermal insulating member 35*b* and the lower inside surface 333*b* of the cylinder bore opposite wall contact member 33*b* are affixed to the bottom surface 343*b* of the base member 34*b* to cover the bottom surface 343*b* of the base member 34*b* and, in addition, the lower inside surface 353*b* of the cylinder bore wall thermal insulating member 35*b* and the lower inside surface 333*b* of the cylinder bore opposite wall contact member 33*b* are affixed to each other, whereby a bottom-side thermal insulation part 39 formed of a heat-expandable rubber is formed on the bottom side of the base member 34*b*, as illustrated in FIG. 16.

Figure 18:
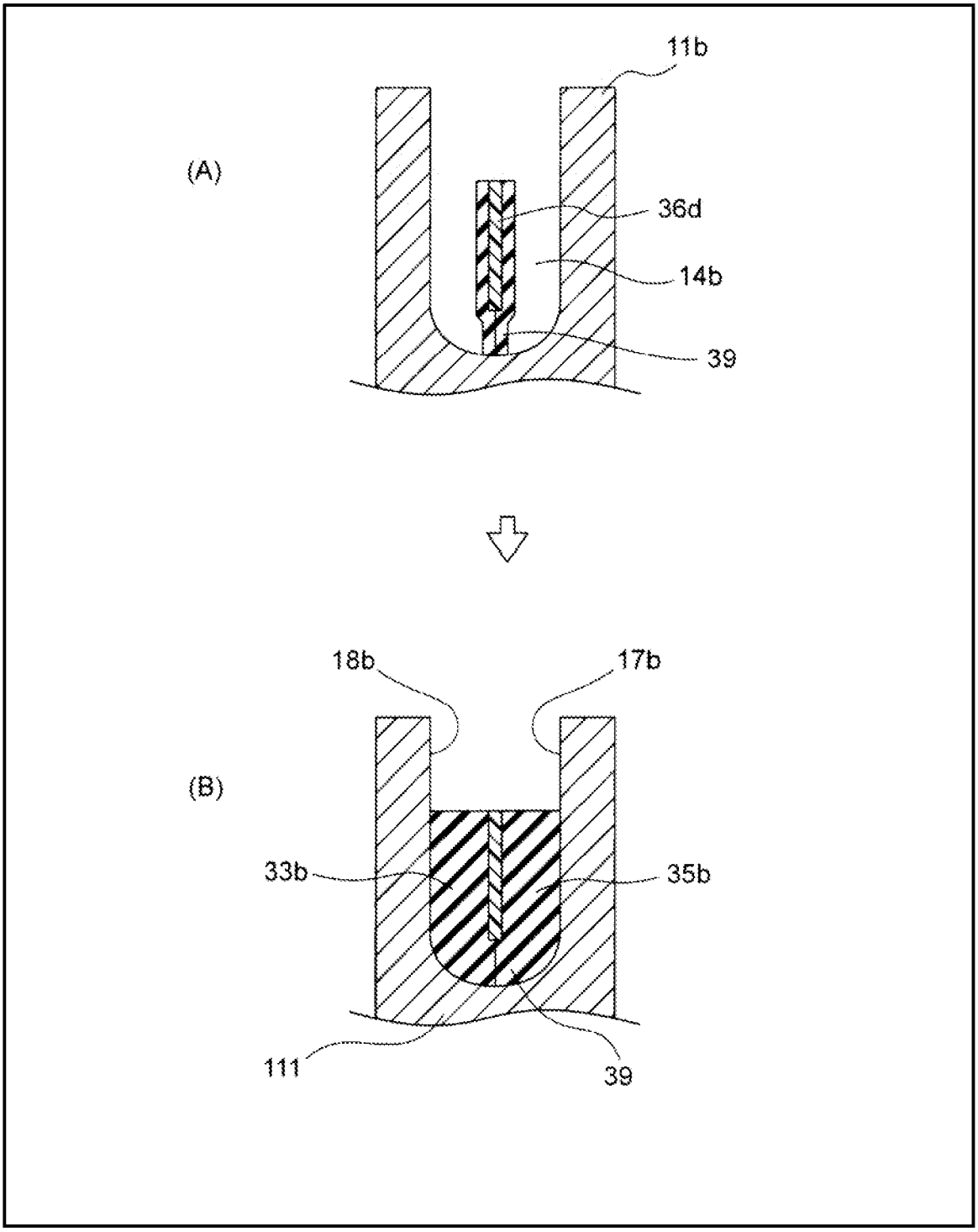
FIG. 18 is a cross-sectional view of the cylinder bore wall thermal insulator in FIG. 16 installed in the groove-like coolant passage.

FIG. 18 illustrates a state in which the cylinder bore wall thermal insulator 36*d* is installed in the cylinder block 11*b*. As illustrated in FIG. 18(A), the cylinder bore wall thermal insulator 36*d* is installed in the groove-like coolant passage 14*b* of the cylinder block 11*b* such that the bottom-side thermal insulation part 39 of the cylinder bore wall thermal insulator 36*d* is in contact with the bottom of the groove-like coolant passage 14*b* of the cylinder block 11*b*. Then, when the heat-expandable rubber is heated after the cylinder bore wall thermal insulator 36*d* is installed in the groove-like coolant passage 14*b*, as illustrated in FIG. 18(B), the cylinder bore wall thermal insulating member 35*b* expands until coming into contact with the cylinder bore wall 17*b*, the cylinder bore opposite wall contact member 33*b* expands until coming into contact with the cylinder bore opposite wall 18*b*, and the bottom-side thermal insulation part 39 expands until coming into contact with the entire bottom surface of the groove-like coolant passage 14*b*. In the cylinder block, heat escapes to the outside from the bottom side of the groove-like coolant passage (the section denoted by a reference sign 111 in FIG. 18(B)). Therefore, as in the cylinder bore wall thermal insulator 36*d*, disposing the thermal insulating member formed of a heat-expandable rubber on the bottom side of the base member enhances the heat insulation of the cylinder bore wall. The bottom side of the groove-like coolant passage of the cylinder block is often curved, as in the example illustrated in FIG. 18. In such a case, a thermal insulating member formed of a heat-expandable rubber is disposed also on the bottom side of the base member, and the thermal insulating member on the bottom side of the base member is shaped to be adapted to the shape of the bottom side of the groove-like coolant passage of the cylinder block after heat expansion, whereby the thermal insulating member is in more intimate contact with the bottom surface of the groove-like coolant passage, thereby enhancing the heat insulation of the cylinder bore wall.

Figure 16:
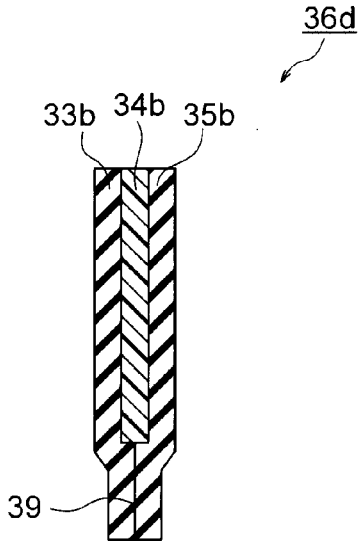
FIG. 16 is a diagram illustrating an example of the cylinder bore wall thermal insulator in the present invention in cross section.
Figure 17:
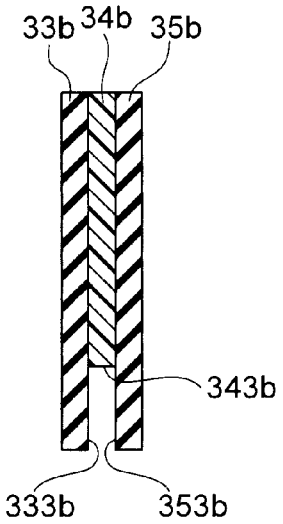
FIG. 17 is a diagram illustrating a state of fabricating an example of the cylinder bore wall thermal insulator in the present invention.

FIG. 16 is a diagram illustrating a cross section of the cylinder bore wall thermal insulator 36*d* which is an example of the cylinder bore wall thermal insulator in the present invention. FIG. 17 is a diagram illustrating a state of fabricating the cylinder bore wall thermal insulator 36*d* illustrated in FIG. 16. FIG. 18 is a cross-sectional view of the cylinder bore wall thermal insulator 36*d* in FIG. 16 installed in the groove-like coolant passage.

The internal combustion engine in the present invention includes a cylinder block having a groove-like coolant passage, in which the cylinder bore wall thermal insulator in the present invention is installed in the groove-like coolant passage.

The cylinder block in the internal combustion engine in the present invention is similar to the cylinder block in the cylinder bore wall thermal insulator in the present invention.

The internal combustion engine in the present invention includes the cylinder block and the cylinder bore wall thermal insulator in the present invention installed in the groove-like coolant passage, as well as a cylinder head, a cam shaft, a valve, a piston, a con rod, and a crank shaft.

In the internal combustion engine with the cylinder bore wall in the present invention, it is preferable that a value represented by Expression (1) below is preferably 17 to 75%, particularly preferably 20 to 40%:

$$((w-t_x)/(t_{0\text{-}IN}+t_{0\text{-}OUT}))\times 100 \quad (1)$$

(in Expression (1), w is the passage width of the groove-like coolant passage, $t_x$ is the thickness of the base member, $t_{0\text{-}IN}$ is the thickness of the cylinder bore wall thermal insulating member in a release state, and $t_{0\text{-}OUT}$ is the thickness of the cylinder bore opposite wall contact member in a release state).

This is because if so, the elastic force of the expanded heat-expandable rubber forming the cylinder bore wall thermal insulating member and the cylinder bore opposite wall contact member is appropriate after expansion to more effectively prevent the cylinder bore wall thermal insulator in the present invention from being displaced from the installation position in the groove-like coolant passage and prevent the cylinder bore wall thermal insulating member and the cylinder bore opposite wall contact member from being displaced from the position where they are affixed to the base member by adhesive, adhesive tape, glue, or the like. In the cylinder block 11*a* in the example illustrated in FIG. 15, the passage width varies when the groove-like coolant passage is viewed in the up-down direction. In this case, of the positions in the up-down direction of the cylinder bore wall thermal insulator in the present invention after the cylinder bore wall thermal insulator in the present invention is installed in the groove-like coolant passage, letting the passage width at the position with the largest passage width be $w_{max}$, and the passage width at the position with the smallest passage width be $w_{min}$, the value of Expression (1) calculated using the value of $w_{max}$ at the position with the largest passage width and the value of Expression (1) calculated using the value of $w_{min}$ at the position with the smallest passage width preferably fall within the range of Expression (1) above.

In Expression (1), $(w-t_x)$ is equivalent to the total thickness of the thickness ($t_{a\text{-}IN}$) of the cylinder bore wall thermal insulating member after heat expansion in the groove-like coolant passage and the thickness ($t_{a\text{-}OUT}$) of the cylinder bore opposite wall contact member after heat expansion in the groove-like coolant passage. Therefore, Expression (1) is the same as Expression (2) below:

$$((t_{a\text{-}IN}+t_{a\text{-}OUT})/(t_{0\text{-}IN}+t_{0\text{-}OUT}))\times 100 \quad (2)$$

(in Expression (2), $t_{a\text{-}IN}$ is the thickness of the cylinder bore wall thermal insulating member after expanding in the groove-like coolant passage, $t_{a\text{-}OUT}$ is the thickness of the cylinder bore opposite wall contact member after expanding in the groove-like coolant passage, $t_{0\text{-}IN}$ is the thickness of the cylinder bore wall thermal insulating member in a release state, and $t_{0\text{-}OUT}$ is the thickness of the cylinder bore opposite wall contact member in a release state).

Expression (2) represents how much the expanded cylinder bore wall thermal insulating member and cylinder bore opposite wall contact member are compressed in the groove-like coolant passage of the cylinder block of the internal combustion engine in the present invention. That is, Expression (2) is equivalent to the compression ratio (%) of the heat-expandable rubber after expansion in the groove-like coolant passage. Therefore, it is preferable that the value represented by Expression (2) is preferably 17 to 75%, particularly preferably 20 to 40%. This is because if so, the elastic force of the expanded heat-expandable rubber forming the cylinder bore wall thermal insulating member and the cylinder bore opposite wall contact member is appropriate after expansion to more effectively prevent the cylinder bore wall thermal insulator in the present invention from being displaced from the installation position in the groove-like coolant passage and prevent the cylinder bore wall thermal insulating member and the cylinder bore opposite wall contact member from being displaced from the position where they are affixed to the base member by adhesive, adhesive tape, glue, or the like. In the present invention, the thickness ($t_{a\text{-}IN}$) of the cylinder bore wall thermal insulating member after heat expansion in the groove-like coolant passage is, as illustrated in FIG. 14(C), the thickness of the expanded heat-expandable rubber after expanding in the groove-like coolant passage, that is, the thickness of the cylinder bore wall thermal insulating member 351*a* after heat expansion in the groove-like coolant passage. The thickness ($t_{a\text{-}OUT}$) of the cylinder bore opposite wall contact member after heat expansion in the groove-like coolant passage is, as illustrated in FIG. 14(C), the thickness of the expanded heat-expandable rubber after expanding in the groove-like coolant passage, that is, the thickness of the cylinder bore opposite wall contact member 331*a* after heat expansion in the groove-like coolant passage. FIG. 14(C) illustrates a state in which the cylinder bore wall thermal insulating member 35*a* and the cylinder bore opposite wall contact member 33*a* illustrated in FIG. 14(A) are heat-expanded in the groove-like coolant passage of the cylinder block 11.

The automobile in the present invention includes the internal combustion engine in the present invention.

INDUSTRIAL APPLICABILITY

According to the present invention, a cylinder bore wall thermal insulator that can be in intimate contact with the cylinder bore-side wall surface of the groove-like coolant passage of the cylinder block and is less likely to be displaced in the groove-like coolant passage can be manufactured through a simple manufacturing process. Therefore, the present invention provides an inexpensive cylinder bore wall thermal insulator that can be in intimate contact with the cylinder bore-side wall surface of the groove-like coolant passage of the cylinder block and is less likely to be displaced in the groove-like coolant passage.

REFERENCE SIGNS LIST

8 lowermost position
9 uppermost position
10 position in the vicinity of the intermediate
11, 11*a*, 11*b* cylinder block
12 bore
12*a*1, 12*a*2 end bore
12*b*1, 12*b*2 intermediate bore
13 cylinder bore wall
14 groove-like coolant passage
15 coolant inlet
16 coolant outlet
17 cylinder bore wall
17*a*, 17*b* wall surface of one-side half
18 cylinder bore opposite wall
21*a*, 21*b* one-side half bore wall
23*a*1, 23*a*2, 23*b*1, 23*b*2 bore wall of each individual cylinder bore

26 contact surface of cylinder bore wall thermal insulating member

27 contact surface of cylinder bore opposite wall contact member

30, 31 gap

33*a*, 33*b* cylinder bore opposite wall contact member before heat expansion

34*a*, 34*b* base member

35*a*, 35*b* cylinder bore wall thermal insulating member before heat expansion

36*a*, 36*b*, 36*c*, 36*d* cylinder bore wall thermal insulator

38 coolant flow-separating member

39 bottom-side thermal insulation part

191 inter-bore part

192 boundary between the bore walls of individual cylinder bores of the cylinder bore-side wall surface of groove-like coolant passage O center axis of cylinder bore $t_{0\text{-}IN}$ thickness of cylinder bore wall thermal insulating member in a release state $t_{0\text{-}OUT}$ thickness of cylinder bore opposite wall contact member in a release state $t_{a\text{-}IN}$ thickness of cylinder bore wall thermal insulating member after expanding in the groove-like coolant passage $t_{a\text{-}OUT}$ thickness of cylinder bore opposite wall contact member after expanding in the groove-like coolant passage $t_{i\text{-}IN}$ thickness of cylinder bore wall thermal insulating member before expansion $t_{i\text{-}OUT}$ thickness of cylinder bore opposite wall contact member before heat expansion w passage width of groove-like coolant passage

The invention claimed is:

1. A cylinder bore wall thermal insulator configured to be installed in a groove-like coolant passage of a cylinder block having cylinder bores in an internal combustion engine, for insulating an entire bore wall of all the cylinder bores or part of the bore wall of all the cylinder bores, the thermal insulator comprising:

a base member made of a synthetic resin and having a shape conforming to a shape of the groove-like coolant passage at an installation position of the thermal insulator;

a cylinder bore wall thermal insulating member formed of a heat-expandable rubber and affixed to inside of the base member;

a cylinder bore opposite wall contact member formed of a heat-expandable rubber and affixed to outside of the base member; and a bottom-side thermal insulation part which covers a bottom of the base member, the bottom-side thermal insulation part being formed by bonding a lower inner surface of the cylinder bore wall then insulating member to a lower inner surface of the cylinder bore opposite wall contact member.

2. The cylinder bore wall thermal insulator according to claim 1, wherein the heat-expandable rubber forming the cylinder bore wall thermal insulating member and the heat-expandable rubber forming the cylinder bore opposite wall contact member are formed with a base foam material and a thermoplastic substance, the base foam material is silicone rubber, fluororubber, natural rubber, butadiene rubber, ethylene-propylene-diene rubber, or nitrile-butadiene rubber, and the thermoplastic substance is a resin or a metal material.

3. The cylinder bore wall thermal insulator according to claim 1, wherein a ratio $((t_{i\text{-}IN}/t_{0\text{-}IN})\times 100)$ of a thickness $(t_{i\text{-}IN})$ of the cylinder bore wall thermal insulating member before heat expansion to a thickness $(t_{0\text{-}IN})$ of the cylinder bore wall thermal insulating member in a release state as well as a ratio $((t_{i\text{-}OUT}/t_{0\text{-}OUT})\times 100)$ of a thickness $(t_{i\text{-}OUT})$ of the cylinder bore opposite wall contact member before heat expansion to a thickness $(t_{0\text{-}OUT})$ of the cylinder bore opposite wall contact member in a release state are 6 to 87%.

4. The cylinder bore wall thermal insulator according to claim 1, wherein the base member has an inside surface having a depression for preventing displacement of the cylinder bore wall thermal insulating member, and the cylinder bore wall thermal insulating member covers the depression.

5. The cylinder bore wall thermal insulator according to claim 1, wherein the base member has an outside surface having a depression for preventing displacement of the cylinder bore opposite wall contact member, and the cylinder bore opposite wall contact member covers the depression.

6. An internal combustion engine comprising a cylinder block having a groove-like coolant passage, wherein the cylinder bore wall thermal insulator according to claim 1 is installed in the groove-like coolant passage.

7. The internal combustion engine according to claim 6, wherein a value represented by Expression (1) below is 17 to 75%:

$$((w-t_x)/(t_{0\text{-}IN}+t_{0\text{-}OUT}))\times 100 \quad (1), \text{ and}$$

in Expression (1), w is a passage width of the groove-like coolant passage, $t_x$ is a thickness of the base member, $t_{0\text{-}IN}$ is a thickness of the cylinder bore wall thermal insulating member in a release state, and $t_{0\text{-}OUT}$ is a thickness of the cylinder bore opposite wall contact member in a release state.

8. The internal combustion engine according to claim 6, wherein a value represented by Expression (2) below is 17 to 75%:

$$((t_{a\text{-}IN}+t_{a\text{-}OUT})/(t_{0\text{-}IN}+t_{0\text{-}OUT}))\times 100 \quad (2), \text{ and}$$

in Expression (2), $t_{a\text{-}IN}$ is a thickness of the cylinder bore wall thermal insulating member after expanding in the groove-like coolant passage, to-our is a thickness of the cylinder bore opposite wall contact member after expanding in the groove-like coolant passage, $t_{0\text{-}IN}$ is a thickness of the cylinder bore wall thermal insulating member in a release state, and $t_{0\text{-}OUT}$ is a thickness of the cylinder bore opposite wall contact member in a release state.

9. An automobile comprising the internal combustion engine according to claim 6.

* * * * *